US005480314A

United States Patent [19]

Campbell

[11] Patent Number: 5,480,314

[45] Date of Patent: Jan. 2, 1996

[54] RETRACTABLE ELECTRIC PLUG

[76] Inventor: Edward I. Campbell, 107 W. 14th St., Frederick, Md. 21701

[21] Appl. No.: 298,314

[22] Filed: Sep. 1, 1994

[51] Int. Cl.[6] ..... H01R 13/62

[52] U.S. Cl. ..... 439/159; 439/152

[58] Field of Search ..... 439/152–160, 439/372

[56] References Cited

U.S. PATENT DOCUMENTS

| | | | |
|---|---|---|---|
| Re. 28,545 | 9/1925 | Harris | 439/159 |
| 2,688,734 | 9/1954 | Welling | 439/159 |
| 4,326,763 | 4/1982 | Ristovski | 439/159 |
| 4,582,379 | 4/1986 | Fasano | 439/159 |
| 4,820,176 | 4/1989 | Nikura | 439/159 |
| 5,266,040 | 11/1993 | Merrill et al. | 439/159 |

*Primary Examiner*—David L. Pirlot

[57] ABSTRACT

A retractable electric plug comprising a housing having a base end adapted for receiving an electrical power cord, a peripheral integral side wall connected to the base end and extended to a location to define a hollow interior and an opening; at least two electrically conductive prongs; a coupling mechanism for coupling the prongs to the housing such that they extend therefrom and are coupleable with an electrical receptacle; and a plunging mechanism coupled to the container and having a retracted orientation for allowing the prongs to be inserted within an electrical receptacle and an extended orientation for forcibly abutting the electrical receptacle for extracting the prongs therefrom.

2 Claims, 4 Drawing Sheets

RETRACTABLE ELECTRIC PLUG

BACKGROUND OF THE INVENTION

1. Field of the Invention

The present invention relates to a retractable electric plug and more particularly pertains to allowing safe and ready removal of an retractable electric plug from an associated electrical receptacle without it or the receptacle being damaged in the removal process.

2. Description of the Prior Art

The use of plug apparatuses is known in the prior art. More specifically, plug apparatuses heretofore devised and utilized for the purpose of allowing themselves to be readily removed from electrical receptacles are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,685,000 to Robbins discloses a line plug with retractable grounding pin. U.S. Pat. No. 3,858,956 to Garrett discloses a ground prong for an electrical plug. U.S. Pat. No. 3,786,392 to McDaniel discloses an automatic retractable ground electrical connector. U.S. Pat. No. 3,792,411 to Jenkins discloses an electric plug with both removable and pivotable ground pins. U.S. Pat. No. 4,081,206 to Lee discloses an electric plug with retractable ground terminal.

While these devices fulfill their respective, particular objective and requirements, the aforementioned patents do not describe a retractable electric plug that includes a plunger for allowing the plug to be safely and readily removed from an electrical receptacle.

In this respect, the retractable electric plug according to the present invention substantially departs from the conventional concepts and designs of the prior art, and in doing so provides an apparatus primarily developed for the purpose of allowing safe and ready removal of itself from an associated electrical receptacle without it or the receptacle being damaged in the removal process.

Therefore, it can be appreciated that there exists a continuing need for new and improved retractable electric plug which can be used for allowing safe and ready removal of itself from an associated electrical receptacle without it or the receptacle being damaged in the removal process. In this regard, the present invention substantially fulfills this need.

SUMMARY OF THE INVENTION

In the view of the foregoing disadvantages inherent in the known types of plug apparatuses now present in the prior art, the present invention provides an improved retractable electric plug. As such, the general purpose of the present invention, which will be described subsequently in greater detail, is to provide a new and improved retractable electric plug and method which has all the advantages of the prior art and none of the disadvantages.

To attain this, the present invention essentially comprises, in combination, a rigid housing having a dome-shaped base end with a central cable hole disposed thereon adapted for receiving an electrical power cord, a peripheral integral tubular side wall connected to the base end and extended therefrom defining a hollow interior and an opening for allowing access to the interior, an arcuate protrusion extended outwards from the side wall near the base end defining a handle adapted for allowing a user a firm grip, and an elongated bore formed through the side wall at a location diametrically opposed to the handle with the bore having an open first end positioned at a location offset from the base end, a open second end positioned at a location adjacent to and flush with the opening, and a bend therebetween having an inwardly projected surface formed thereon constituting a lip. A planar circular rigid prong plate is included and secured over the opening with the prong plate having two spaced and parallel prong slots formed thereon allowing access to the interior and a plunger hole formed thereon at a location aligned with the second end of the bore. A pair of elongated electrically conductive prongs is included with each prong having a first end coupled to the prong plate adjacent to the interior and a second end extended through a separate prong slot and with the second ends of the prongs adapted to be inserted within an electrical receptacle for receiving electrical power therefrom. An elongated cylindrical plunger is included and has a first leg with a first free end, a second leg with a second free end, a bend formed therebetween, and a flange formed about the second leg at a location adjacent to the bend. The plunger is slidably disposed within the bore such that its first free end extends angularly outwards from the first end thereof, its second free extends outwards from the second end thereof, its bend is positioned within the bend thereof, and the flange is abuttable against the lip thereof. Lastly, a spring is included and disposed about the second leg of the plunger between the prong plate and the lip. The spring is positionable in a biased orientation with the second leg of the plunger projected from the bore, thereby placing the plunger in an extended configuration. The spring is also positionable in an unbiased orientation with the second leg of the plunger withdrawn into the bore, thereby placing the plunger in a retracted orientation. When the prongs are inserted within an electrical receptacle, pushing the first free end of the plunger places the plunger in an extended configuration with its second free end forcibly abutted against the receptacle for extracting the prongs therefrom.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved retractable electric plug which has all the advantages of the prior art plug apparatuses and none of the disadvantages.

It is another object of the present invention to provide a new and improved retractable electric plug which may be easily and efficiently manufactured and marketed.

It is a further object of the present invention to provide a new and improved retractable electric plug which is of durable and reliable construction.

An even further object of the present invention is to provide a new and improved retractable electric plug which is susceptible of a low cost of manufacture with regard to both materials and labor, and which accordingly is then susceptible of low prices of sale to the consuming public, thereby making such a retractable electric plug economically available to the buying public.

Still yet another object of the present invention is to provide a new and improved retractable electric plug which provides in the apparatuses and methods of the prior art some of the advantages thereof, while simultaneously overcoming some of the disadvantages normally associated therewith.

Even still another object of the present invention is to provide a new and improved retractable electric plug for allowing safe and ready removal of itself from an associated electrical receptacle without it or the receptacle being damaged in the removal process.

Lastly, it is an object of the present invention to provide a new and improved retractable electric plug comprising a housing having a base end adapted for receiving an electrical power cord, a peripheral integral side wall connected to the base end and extended to a location to define a hollow interior and an opening; at least two electrically conductive prongs; coupling means for coupling the prongs to the housing such that they extend therefrom and are coupleable with an electrical receptacle; and plunging means coupled to the container and having a retracted orientation for allowing the prongs to be inserted within an electrical receptacle and an extended orientation for forcibly abutting the electrical receptacle for extracting the prongs therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
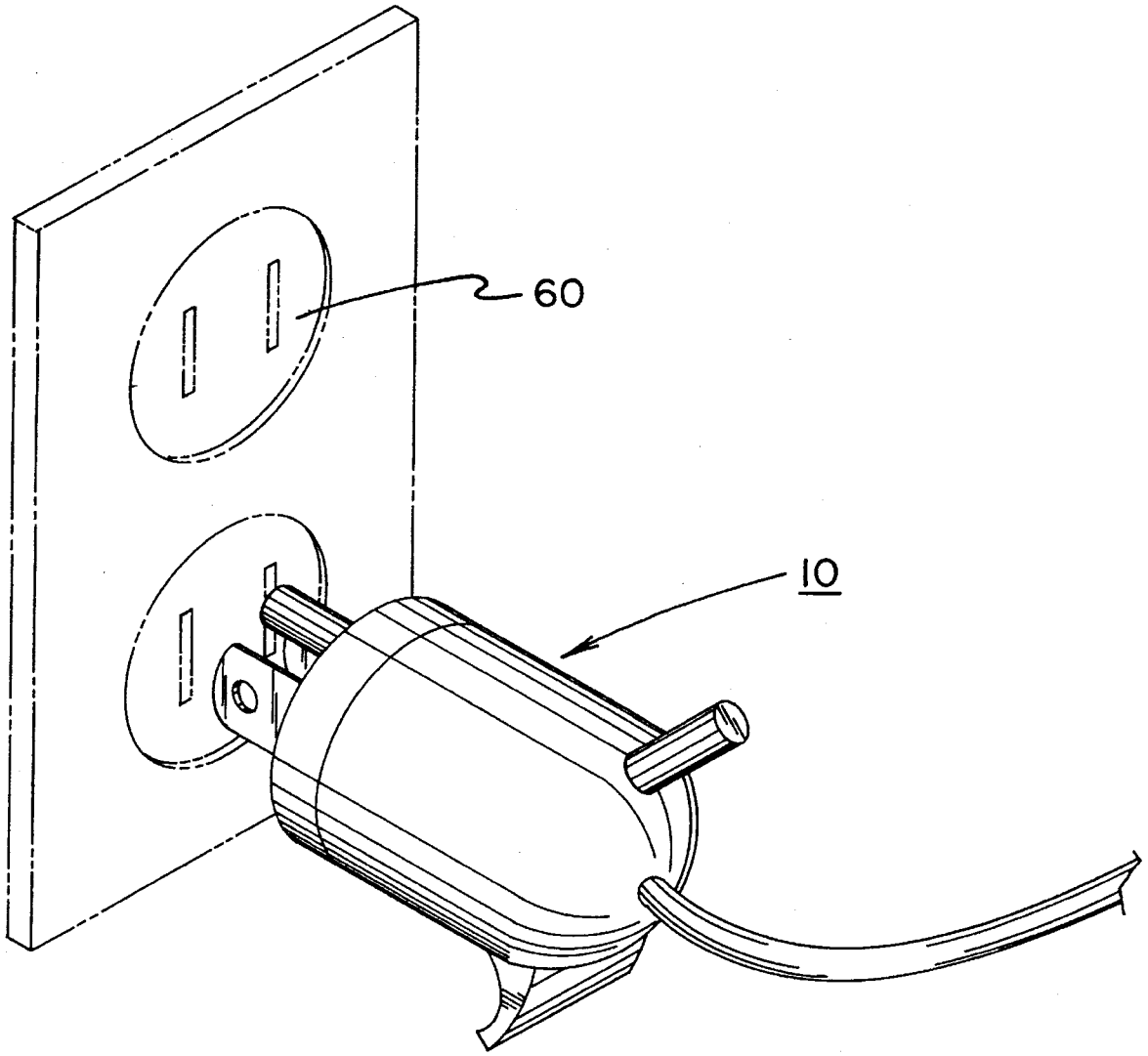
FIG. 1 is a perspective view of the preferred embodiment of the retractable electric plug constructed in accordance with the principles of the present invention.

With reference now to the drawings, and in particular, to FIG. 1 thereof, the preferred embodiment of the new and improved retractable electric plug embodying the principles and concepts of the present invention and generally designated by the reference number 10 will be described.

Specifically, the present invention essentially includes five major components. The major components are the housing, prong plate, prongs, plunger, and spring. These components are interrelated to provide the intended function.

More specifically, it will be noted in the various Figures that the first major component is the housing 12. The housing has a dome-shaped base end 14 with a central cable hole 16 disposed thereon and aligned with the central axis of the base end. The cable hole is adapted for receiving and electrical power cord 18 from an electrical appliance therein. The housing also includes an integral tubular side wall 20 connected to the base end and extended therefrom and defining a hollow interior 22. The opened end of the side wall defines an opening 24 for the housing. This opening allows access to the interior. The housing also includes an arcuate protrusion extended outwards from the side wall at a location near the base end with the protrusion defining a handle 26 adapted for allowing a user a firm grip of the housing. The housing also includes an elongated bore 28 formed through the side wall at a location diametrically opposed to the handle. The bore has an open first end 30 positioned at a location offset from the base end. The bore also has an open second end 32 positioned at a location adjacent to and flush with the opening. A bend 34 is formed between the open first end and the open second end. The bend has an inwardly projected surface formed thereon constituting a lip 36.

The second major component is the prong plate 40. The prong plate is planar, circular, and rigid in structure. It is secured over the opening. The prong plate has two spaced and parallel prong slots 42 formed thereon for allowing access to the interior and a plunger hole 46 formed thereon at a location aligned with the second end 32 of the bore. The prong plate shields the interior of the container from dust, water, and the like.

The third major component is the prongs 50. The present invention includes a pair of spaced elongated prongs. The prongs are formed of an electrically conductive material. Each prong has a first end 52 coupled to the prong plate with a screw 54. A terminal wire 56 is also coupleable to the first end of the prong with the screw. This terminal wire is extended from an electrical power cord 18. Each prong also has a second end 58 extended through a separate prong slot 42. The second ends of the prongs are adapted to be inserted within an electrical receptacle 60 for receiving electrical power therefrom for subsequent transfer to the terminal wires of the power cord and then to an appliance.

The fourth major component is the plunger 70. The plunger is elongated and cylindrical in structure. It has a first leg 72 with a first free end, a second leg 74 with a second free end, and a bend 76 formed therebetween. The angle between the first leg and second leg is set between 90 degrees and 180 degrees, with a preference being 45 degrees. A flange 78 is formed about the second leg at a location adjacent to the bend. The plunger is slidably disposed within the bore 28 such that its free end extends angularly outwards from the first end 30 thereof. Its second free end extends outwards from the second end 32 of the bore. Lastly, the bend of the plunger is positioned within the bend 34 of the bore. The flange is thereby abuttable against the lip 36 of the bore. The flange also has a radial extent larger than that of the plunger hole of the prong plate. These dimensions ensure that the plunger remains secured within the housing.

Figure 2:
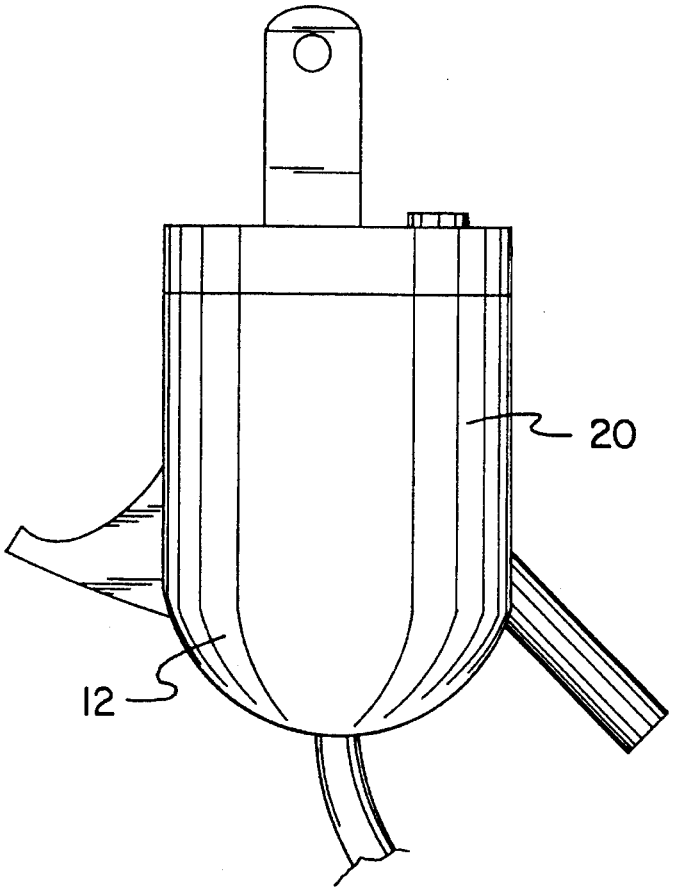
FIG. 2 is a side elevational view of the present invention with the plunger in a retracted configuration.
Figure 3:
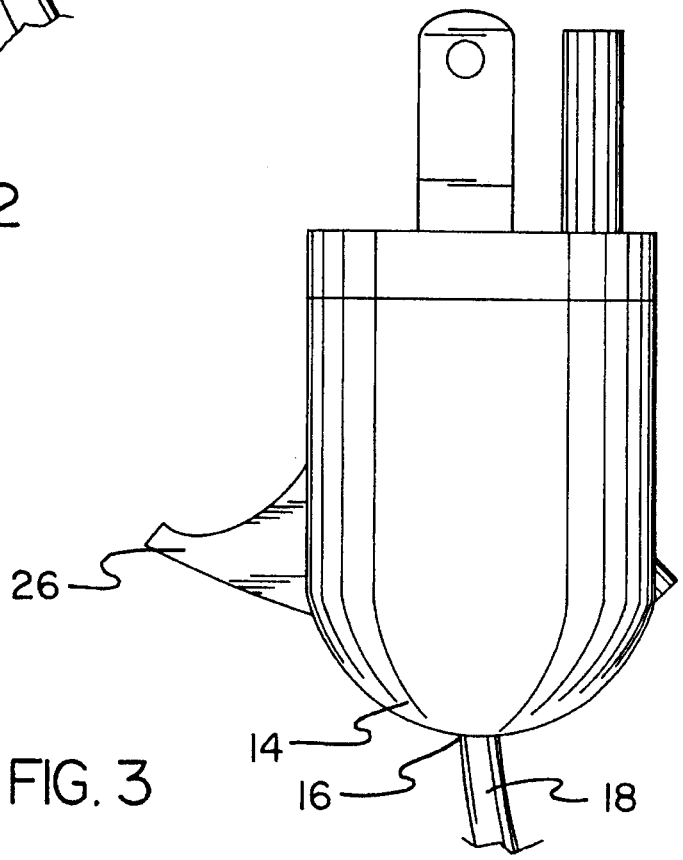
FIG. 3 is yet another side elevational view of the present invention with the plunger in extended orientation.
Figure 4:
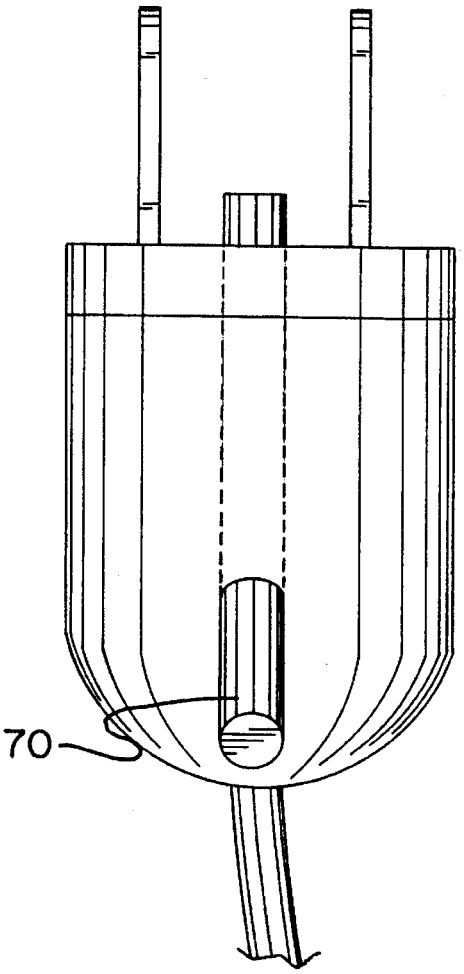
FIG. 4 is yet another side elevational view of the present invention with the plunger positioned at a location intermediate between the retracted configuration and extended configuration.
Figure 5:
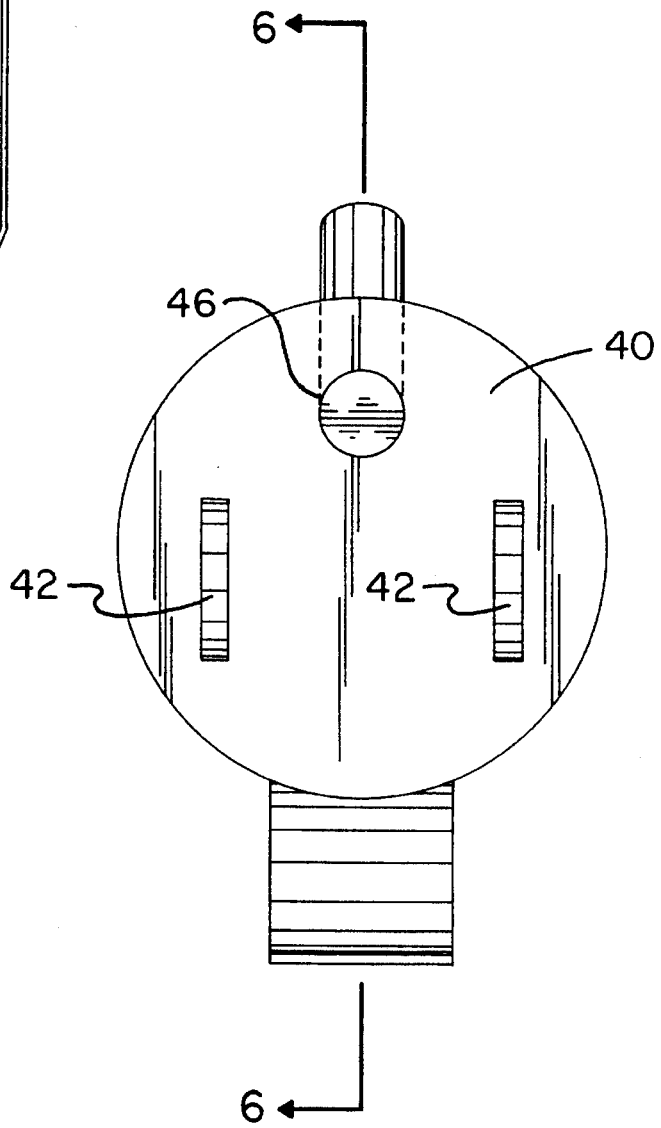
FIG. 5 is a plan view of the present invention as viewed along the prongs thereof.
Figure 6:
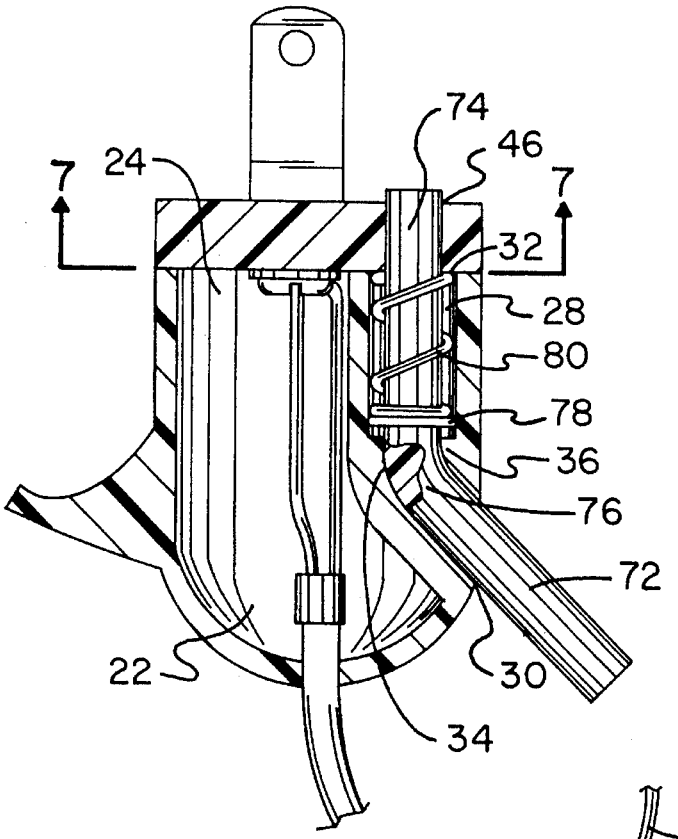
FIG. 6 is a cross-sectional view of the present invention taken along the lines 6—6 of FIG. 5.
Figure 7:
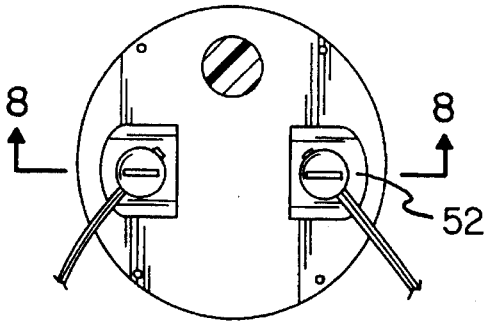
FIG. 7 is a view of the prong plate and its associated coupling with prongs and terminal lines. The terminal lines are extended from an associated external power cord.
Figure 8:
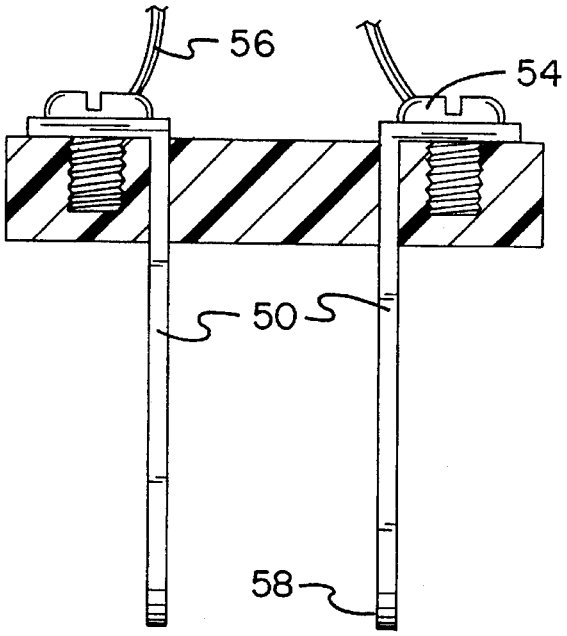
FIG. 8 is a cross-sectional view of the present invention taken along the line 8—8 of FIG. 7.

The fifth major component is the spring 80. The spring is disposed about the second leg 74 of the plunger between the prong plate 40 and the lip 36. The spring is positionable in a biased orientation with the second leg of the plunger projected from the bore 28. The spring thereby places the plunger in an extended configuration as shown in FIG. 3. The spring is also positionable in an unbiased orientation such that the second leg of the plunger is withdrawn into the bore through urging of the spring. The spring positioned in this manner places the plunger in a retracted orientation as shown in FIG. 2. With the prongs of the present invention inserted within an electrical receptacle 60, pushing the first free end of the plunger places the plunger in an extended configuration with its free end forcibly abutted against the receptacle. This force allows the prongs to be extracted from the receptacle in a smooth linear fashion, thereby avoiding any damage to the plug or electrical receptacle. The handle simultaneously allows a user to maintain control of the present invention when depressing the plunger. Furthermore, this extraction process can be performed with just one hand.

The present invention is an electrical plug which is easily and safely removed from an electrical receptacle by pushing on a plunger which protrudes from the side wall of the housing. The plug is similar to other plugs, but contains a cylindrical plunger which is spring loaded so it is normally to and flush with the prong plate. However, when the first free end of the plunger which protrudes out diagonally near the base end of the present invention is depressed, the plunger is forced forward, causing the spring to contract and thereby removing the prongs from a receptacle. The plunger is made of a non-conducting material that poses no electrical shock hazard.

Most people remove plugs from receptacles by tugging on the electrical cord, or by wiggling the plug back and forth furiously. Soon the cord becomes frayed, the wires are exposed, the prongs are bent, or the associated electrical receptacle is damaged. This damage create dangerous conditions that can lead to a person receiving an electrical shock. This present invention allows the plug to be removed from the electrical receptacle by a simple firm press on the extension plunger. The plunger forces the plug back in a straight line, imposing no side loads or no strains on the wiring. Once withdrawn, the plunger is retractable into the plug.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A retractable electric plug for allowing safe and ready removal of itself from an associated electrical receptacle without it or the receptacle being damaged in the removal process comprising, in combination:

a rigid housing having a dome-shaped base end with a central cable hole disposed thereon adapted for receiving an electrical power cord, a peripheral integral tubular side wall connected to the base end and extended therefrom defining a hollow interior and an opening for allowing access to the interior, an arcuate protrusion extended outwards from the side wall near the base end defining a handle adapted for allowing a user a firm grip, and an elongated bore formed through the side wall at a location diametrically opposed to the handle with the bore having an open first end positioned at a location offset from the base end, a open second end positioned at a location adjacent to and flush with the opening, and a bend therebetween having an inwardly projected surface formed thereon constituting a lip;

a planar circular rigid prong plate secured over the opening, the prong plate having two spaced and parallel prong slots formed thereon allowing access to the interior and a plunger hole formed thereon at a location aligned with the second end of the bore;

a pair of elongated electrically conductive prongs with each prong having a first end coupled to the prong plate adjacent to the interior and a second end extended through a separate prong slot, the second ends of the prongs adapted to be inserted within an electrical receptacle for receiving electrical power therefrom;

an elongated cylindrical plunger having a first leg with a first free end, a second leg with a second free end, a bend formed therebetween, and a flange formed about the second leg at a location adjacent to the bend, the plunger slidably disposed within the bore such that its first free end extends angularly outwards from the first end thereof, its second free extends outwards from the second end thereof, its bend is positioned within the bend thereof, and the flange is abuttable against the lip thereof; and a spring disposed about the second leg of the plunger between the prong plate and the lip, the spring positionable in a biased orientation with the second leg of the plunger projected from the bore, thereby placing the plunger in an extended configuration, the spring positionable in an unbiased orientation with the second leg of the plunger withdrawn into the bore, thereby placing the plunger in a retracted orientation;

whereby when the prongs are inserted within an electrical receptacle, pushing the first free end of the plunger places the plunger in an extended configuration with its second free end forcibly abutted against the receptacle for extracting the prongs therefrom.

2. A retractable electric plug comprising:

a housing having a base end adapted for receiving an electrical power cord, a peripheral integral side wall connected to the base end and extended to a location to define a hollow interior and an opening;

an arcuate handle coupled to the housing for allowing a user a firm grip;

at least two electrically conductive prongs;

coupling means for coupling the prongs to the housing such that they extend therefrom and are coupleable with an electrical receptacle;

a prong plate coupled over the opening with the prongs extended therethrough; and an elongated spring-loaded extendable plunger secured to the housing having a first end, a second end, and a bend formed therebetween; the first end extended angularly outwards at a location offset from the base end and diametrically opposed to the handle; the second end extended through the prong plate; the plunger having a retracted orientation for allowing the prongs to be inserted within an electrical receptacle and an extended orientation for forcibly abutting the electrical receptacle for extracting the prongs therefrom.

* * * * *